United States Patent [19]

Seragnoli

[11] 4,352,264

[45] Oct. 5, 1982

[54] MACHINE FOR WRAPPING AND BATCHING PRODUCTS

[75] Inventor: Enzo Seragnoli, Bologna, Italy

[73] Assignee: G. D. Societa per Azioni, Bologna, Italy

[21] Appl. No.: 136,299

[22] Filed: Apr. 1, 1980

[30] Foreign Application Priority Data

May 4, 1979 [IT] Italy ..... 3392 A/79

[51] Int. Cl.[3] ..... B65B 35/30; B65B 11/28

[52] U.S. Cl. ..... 53/531; 53/171; 53/234

[58] Field of Search ..... 53/171, 225, 234, 531, 53/540, 542, 543, 544; 198/374, 411; 414/107

[56] References Cited

U.S. PATENT DOCUMENTS

| | | | |
|---|---|---|---|
| 3,250,373 | 5/1966 | Yakoshita | 198/411 |
| 3,502,194 | 3/1970 | Perry | 198/411 |
| 3,503,484 | 3/1970 | Moshetich | 198/374 |
| 3,890,766 | 6/1975 | Hatta | 53/234 |
| 3,977,159 | 8/1976 | Seragnoli | 53/234 |
| 3,978,639 | 9/1976 | Ferrozzi | 53/234 |
| 4,178,122 | 12/1979 | Abrahamson | 53/540 |

FOREIGN PATENT DOCUMENTS

| | | | |
|---|---|---|---|
| 2730836 | 1/1978 | Fed. Rep. of Germany | 53/234 |

*Primary Examiner*—John Sipos

*Attorney, Agent, or Firm*—Browdy and Neimark

[57] ABSTRACT

Disclosed herein is an improved machine for wrapping and batching products wherein between a product entry position in a wrapping wheel and a position for the egress and expulsion of the products from the said wrapping wheel, provision is made for a position in which a device for grasping and rotating individual products is placed. This device has jaws for grasping the products and is provided with a two way movement along a sliding axis parallel to the axis of rotation of the wrapping wheel, and with a reciprocating movement around the said axis in time with the aforementioned two way movement, the said jaws being phased to match the opening and closing of the product grasping and transfer grippers with which the wrapping wheel is provided.

4 Claims, 5 Drawing Figures

MACHINE FOR WRAPPING AND BATCHING PRODUCTS

BACKGROUND OF THE INVENTION

The invention relates to an improved machine for wrapping and packaging products, and more particularly a machine destined to wrap and orient individual products that are substantially parallelepipeds and/or of a flattened shape (caramels and pastilles, etcetera) and then to pack a predetermined number of such individually wrapped products into a unitary package.

DESCRIPTION OF THE PRIOR ART

As is known, a plurality of products formed by a machine of the above mentioned type constitute, after an overwrapping operation has been carried out, the type of packs commonly called in Italy "sticks".

In usual packs, the products that go to make up the sticks are placed side by side with their major dimensional surfaces facing each other or, in other words, they are placed with their flats, towards each other.

Sticks have recently been introduced on the market wherein the said products, parallelepipeds of a flattened shape, are placed side by side with their major dimensional surfaces side by side and coplanar.

In the known art, sticks of the first and second type described are formed on different machines which are constructed specially to produce one or the other type of the said sticks.

Known commercially is a machine for wrapping items of confectionery or similar products that is assigned to the same assignee as this application—G. D. S.p.A.—and is designed to individually wrap products of the above mentioned type and to group them into batches in which the products are placed on the flat, one with respect to the other. This machine is described and claimed in U.S. Pat. No. 3,977,159.

In the said machine, the products are supplied to the wrapping area by a disk on a vertical axis that rotates intermittently around its axis and is provided with a ring of peripheral holes inside which the products are housed with their largest pair of faces oriented horizontally.

Suitable lifting devices at a transfer station extract the products in succession from the said holes and raise them until they are inserted, in the region of what is called the entry position, between the arms of grippers provided on a wrapping head which is intermittently rotated about a horizontal axis thru a quarter turn per operation.

At the time each product is passing from the said disk to the said wrapping head, it comes into contact with a cut sheet of wrapping material fed in a known fashion.

The wrapping of the product in the cut sheet is initiated while the product is being transferred from the disk to the wrapping head, and is completed by stationary and movable folder members at the time the wheel is effecting its first rotational step.

The wrapped products, thru subsequent rotational steps, arrive at what is called the expulsion position located upstream, in the direction in which the wrapping head rotates, i.e., at the 270° point with respect to the entry position.

In the said expulsion position, the products, placed on edge with respect to the horizontal plane, are extracted from the grippers by pusher devices which provided with a reciprocating movement in a direction radial with respect to the wrapping head, and the products are inserted, one after another into a horizontal egress channel.

Batches constituted by products placed on the flat, i.e., major faces facing each other, are thus formed.

The said batches, removed from the egress channel by known devices create, after an overwrapping operation has been carried out, sticks of the first type described.

SUMMARY OF THE INVENTION

The object of the invention is to provide an improved machine of the type described, which is able, as required, to produce at different times sticks containing products side by side on the flat, or sticks containing products placed with their major dimensional surfaces in line; and, therefore, to dispense with the need to have two different types of machines constructed expressly to produce sticks of only one or the other type.

To attain this object the applicant has improved the above described machine by providing a device, in an intermediate position between that position where the products enter the wrapping wheel and that position where the products are expelled therefrom. This position is called the product turnover position. This device for grasping and rotating individual products is placed downstream of the said folder members that attend to finalizing the wrapping of each individual product, in the region of a waiting position for the grippers provided on the wrapping head, as well as such devices for opening and closing the grippers at a halt in the said expulsion position and in the said entry position, respectively, and for opening and subsequently closing the grippers at a halt in the said turnover position, that operate in phase with the said device for grasping and rotating individual products and with the movement and waiting timing of the wrapping head, and that are interchangeable or selectively replaceable with such similar devices that open and close the grippers only when they are stopped in the said expulsion position and in the said entry position, respectively.

With this solution, and in accordance with the object applicant attained, the possibility exists depending upon the requirements, of overturning by 90° or not overturning at all products that are already wrapped and are in the process of being transferred towards the expulsion position, so that they arrive at the said position in such a way as to be placed, with their longest pair of faces oriented either on the flat or in line depending upon the type of stick it is desired to produce.

BRIEF DESCRIPTION OF THE DRAWINGS

The characteristics of the machine forming the subject of the invention will emerge more obviously from the detailed description that follows of one preferred form of embodiment, illustrated purely by way of example in the accompanying drawings, in which.

DESCRIPTION OF THE PREFERRED EMBODIMENT

Figure 1:
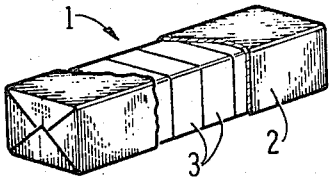

In FIG. 1, (1) indicates a batch of products, defined hereinafter a the first type, covered with a sheet of overwrapping material (2) and composed of products (3), wrapped individually, that are substantially parallelepipeds of a flattened shape, caramels for example, one placed beside the other with their major faces facing each other.

Figure 2:
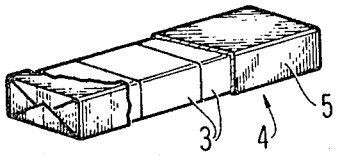
FIGS. 1 and 2 show, in a perspective view, the two different types of sticks it is possible to create out of batches of products formed on the machine in question.

In FIG. 2, shown generally at (4), there is a batch, defined hereinafter as the second type, covered with a sheet of overwrapping material (5), in which the said products (3), wrapped individually, are placed one beside the other with their major dimensional surfaces coplanar.

Figure 3:
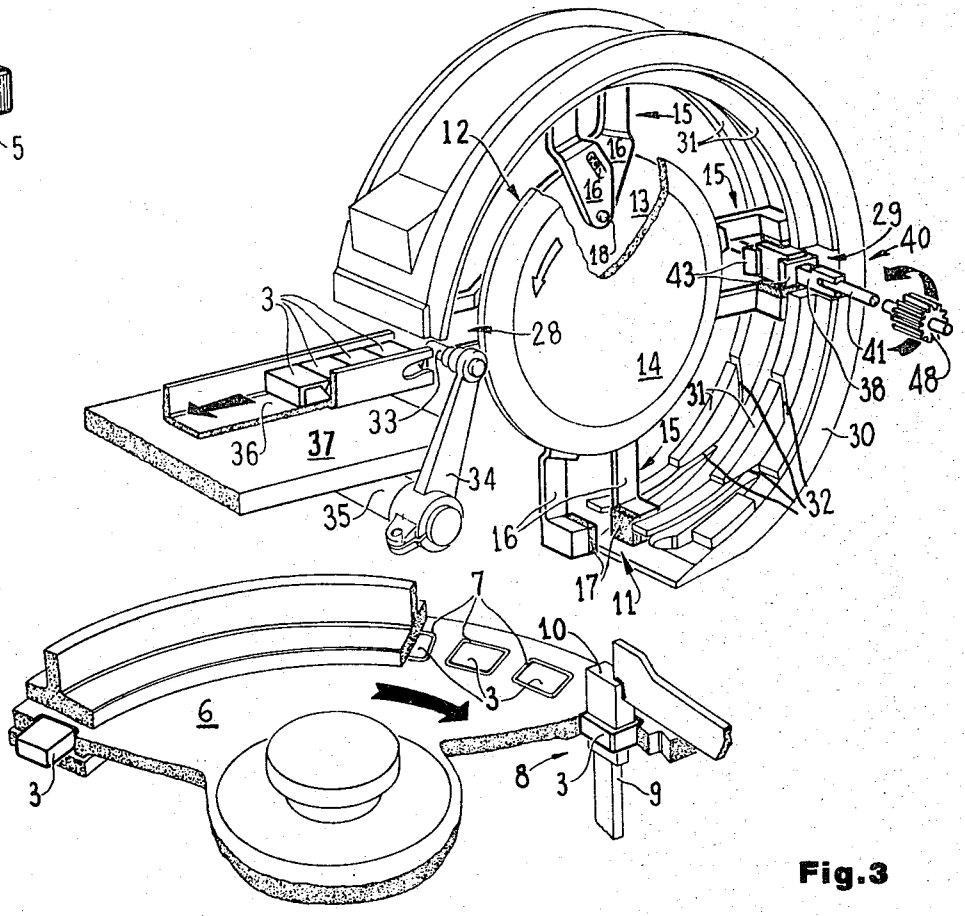
FIG. 3 shows partially the machine of the invention in a perspective view, with emphasis being placed just on the devices for grasping and transferring individual products and for folding the relevant sheet of wrapping material.

With reference to FIG. 3, at (6) is shown a device for conveying individual products (3), consisting of a disk that rotates intermittently about a vertical axis thereof under the action of known means that is not illustrated, and is peripherally provided with a ring of rectangular holes (7).

The said disk (6), to which prior reference has already been made has the task of supplying individual products (3) contained in the rectangular holes (7) to a position (8) for transfer to the wrapping apparatus of the machine in question.

The product (3) contained in the hole (7) is, in the said transfer position (8), supported at the bottom by lifting means (9) which performs a vertical reciprocating movement during each halt of the disk (6).

In the said transfer position (8), using devices of a known type, a sheet or cutting of wrapping material, not shown on the drawings, is supplied and positioned above the hole (7) in which the product (3) is contained. The said sheet is carried into adherence with the upper surface of the product (3) by counter lifting means (10) provided with a vertical reciprocating motion.

While the conveyor disk (6) is at a standstill, the lifting means (9) and the counter lifting means (10) move synchronously upwards and grip between them both the product (3), placed horizontally, and the said cutting of wrapping material.

During the said transfer, stationary folder members, not shown in the drawings, commence folding the said cutting around the product (3) which, once its upward travel is over, is inserted, partially wrapped, in the region of a position (11) defined as the entry position, into a wrapping wheel (12).

The said wrapping wheel (12) comprises a disk (13) on a horizontal axis (see also FIG. 5) delimitated at the front (when looking at FIG. 3) by a cover (14).

Movement devices of known types attend to the intermittent displacement, counterclockwise, with rotations of 90° per operation, of the wrapping wheel (12).

The disk (13) carries four grippers (15), angularly equidistant, a pair of arms of which, shown at (16), extend in a direction radial with respect to the wrapping wheel (12).

Furthermore, the adjustment of the wrapping wheel (12) is such that after each 90° rotation of the wheel about its shaft, the pair of arms 16 of a gripper (15) are positioned to a point corresponding to the entry position (11).

The grasping ends of the arms (16) have attached pads (17) made of suitable material, rubber for example, which guarantee the said products (3) being clasped positively yet delicately.

The disk (13) is provided with four pins (18) parallel to the horizontal axis thereof (see best FIG. 5), inserted into holes (19) made, in the form of a cross, in proximity of the center of the said disk.

Futhermore, on the periphery of the disk (13) there are four radial compartments (20) in alignment, along their longitudinal dimension, with each of the said pins (18).

The two arms (16) of each of the grippers (15) are pivoted, one superposed over the other, about one of the pins (18) (see again FIG. 5) and are provided with, in the intermediate region parallel to the plane on which the disk (13) lies, thru slots (21) that are included at given angles and in opposite directions with respect to the corresponding compartment (20).

Inside each of the said compartments (20) is mounted, in a way whereby it can slide longitudinally, a parallelepiped in the form of a block or slide (22) thru which passes a pin (23) parallel to the axis of the wrapping wheel (12).

Figure 5:
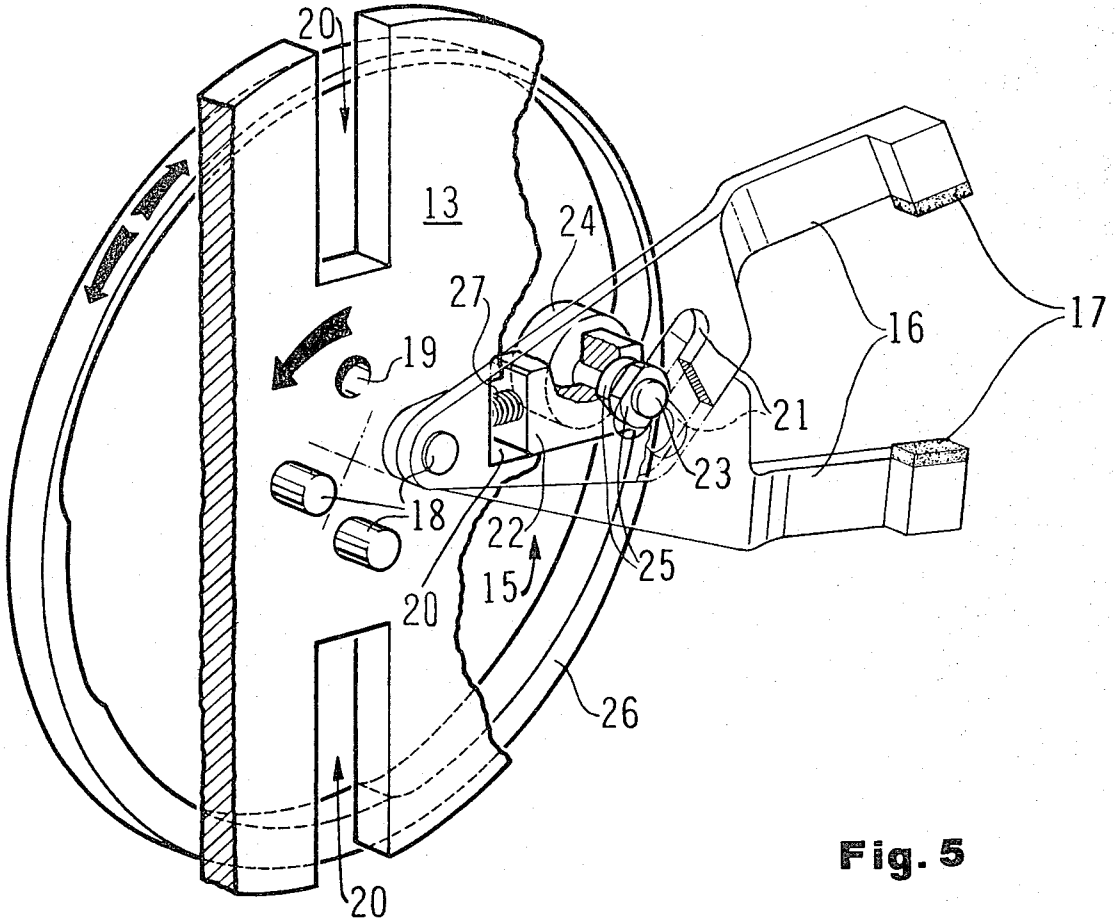
FIG. 5 shows, diagrammatically and in a perspective view, the device that attends to the opening and closing of the grippers on the wrapping wheel at a point corresponding to the position where the products are overturned.

At the rear end, when looking at FIG. 5, of each pin (23) is mounted an idle roller (24), while the front end thereof carries two blocks (25) that are able to slide inside the slots (21).

The idle rollers (24) are placed in contact with the internal profile of a ring shaped cam (26) positioned behind the disk (13) (see FIG. 5) that is coaxial to the wrapping wheel (12). The cam (20) is given thru means that are not illustrated, an oscillating rotatory motion about its own axis.

As a consequence of the described connection, when displacements occur between the cam (26) and the rollers (24), the blocks (22), under the action of springs (27), effect radial sliding movements in the opposite directions within their corresponding radial compartments (20) and, thru the blocks (25) cause the opening or the closing of the arms (16) of the grippers (15).

The internal profile of the cam (26) and the means that govern its oscillating movement are such as to bring about the opening and, subsequently, the closing of each of the grippers (15) in given positions while each rotation cycle of the wrapping wheel (12) is taking place.

More particularly, the arms (16) of each of the grippers (15) are caused to open both in the region of the said entry position (11), for the purpose of allowing the insertion of the products, and in the region of a position shown at (28) and defined as the egress or expulsion position, the latter being located 270° downstream, in the movement direction of the wrapping wheel (12), with respect to the former, for the purpose of allowing the extraction of the products from the wrapping wheel (12).

According to one fundamental characteristic of the improved machine forming the subject of the invention, provision is made, furthermore, for the cam (26) to control the opening and, subsequently, the closing of each of the grippers (15) in the region of a position (29) defined, for reasons that will become clear hereinafter, as the product overturning position, situated 90° downstream with respect to the said entry position (11).

A carinated guide (30), coaxial to the wrapping wheel (12) (see FIG. 3), flanks the periphery of the latter over an arc of approximately 270° in the direction of its motion between the entry position (11) and the expulsion position (28) of the products (3).

The carinated guide (30) defines, in combination with two annular elements (31) provided internally thereof, a channel within which the grasping end of the grippers (15) slide as the wrapping wheel (12) rotates.

In the section of the said channel located within an arc of 90° commencing from the entry position (11), stationary folder members of a known type are provided, shown generally, and at (32) are constituted by helical flutes machined into the annular elements (31).

A pusher or extractor (33) operates in the region of the expulsion position (28) wherein the grippers (15) halt in succession, and this pusher is supported by a lever arm (34) fixed, at one extremity, onto a shaft (35) parallel to the axis of the wrapping wheel (12) and connected to drive means, not depicted, which provide it with an oscillating rotary motion about it's own axis.

Because of the said connection, after each forward movement of the wrapping wheel (12) the pusher or extractor (33) undergoes a forward and backward movement in a direction virtually radial with respect to the wrapping wheel (12), through the grasping extremities of the grippers (15) at a standstill in the egress or expulsion position (28).

Arranged in line with the path followed by the pusher or extractor (33) in proximity of the wrapping wheel (12), a fixed egress channel (36), supported by a horizontal plate (37), is provided.

In the region of the overturning position (29) wherein the annular elements (31) have a break in their continuity, provision is made for blocks or jaws for grasping and rotating the products, shown, from right to left when looking at FIG. 4, at (38) and (39), and hereinafter more briefly called jaws.

The said jaws (38) and (39) are part of a device for grasping and rotating individual products (3), shown generally at (40), whose structure is substantially symmetrical with respect to the plane in which the wrapping wheel (12) lies, and mounted at the righthand and lefthand ends of the respective jaws are two coaxial shafts (41) and (42) which are parallel to the axis of the wrapping wheel (12).

The grasping ends of the jaws (38) and (39) are constituted by rectangular plates (43) delimitated on the two opposite sides by protruding borders (44) designed to guarantee the positive grasping of the products (3).

Figure 4:
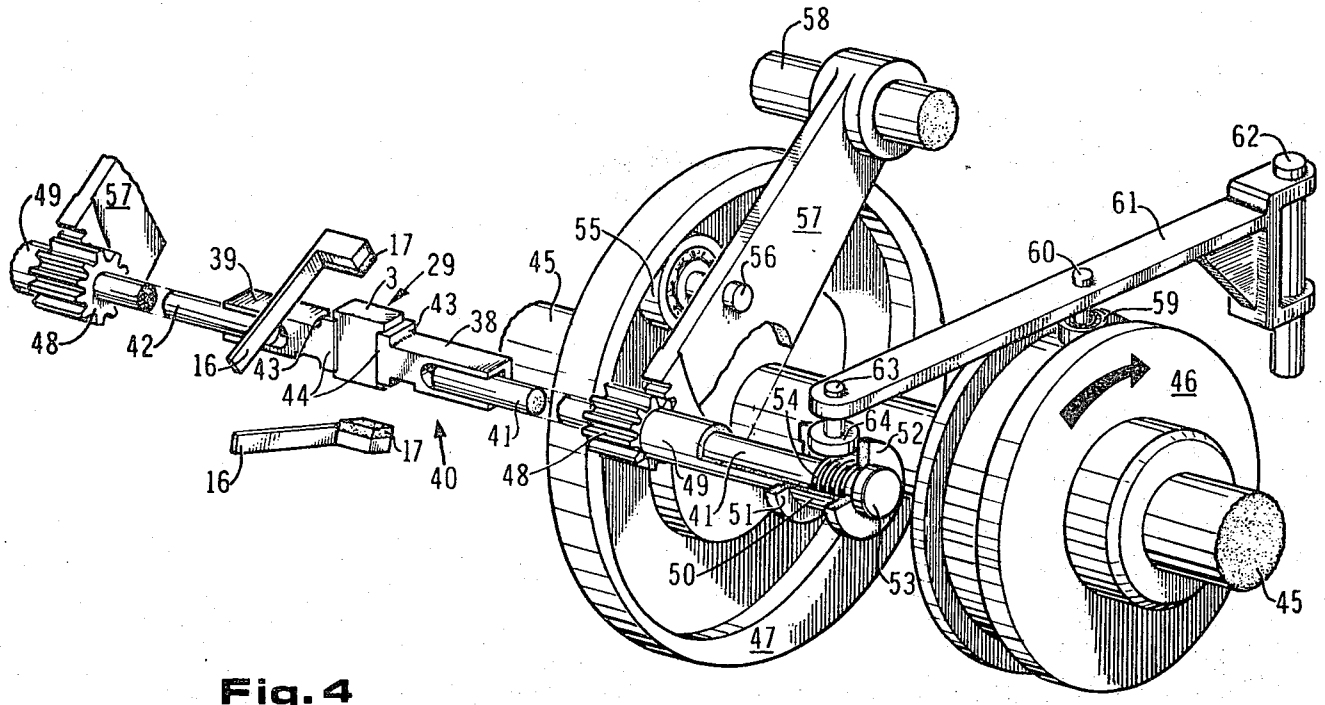
FIG. 4 shows, diagrammatically and in a perspective view, the device for grasping and rotating individual products, and the relevant movement devices, the latter only illustrating one of the two products grasping and rotating blocks or jaws since the other is identical thereto.

It should also be noted, in accordance with what is shown in FIG. 4, that the jaws (38) and (39) are mounted on their corresponding shafts (41) and (42) in a way that allows them to be set in the direction of the axis of the shafts. This makes it possible to adjust the positioning of the said jaws to the specific dimensions of the products (3).

The two shafts (41) and (42) are connected through connection devices decribed below, to a common drive shaft (45) parallel to the axis of the wrapping wheel (12), in order to perform synchronous axial to-and-fro linear movements towards and away from each other at the overturning position (29) and with synchronous rotation movement about their respective axes.

On the extreme right, when looking at FIG. 4, of the drive shaft (45) are fixedly mounted a cylindrical cam (46) and a plate cam (47) which constitute, in the manner described below, the means for controlling the movement of the shaft (41).

The shaft 41 carries, keyed to the intermediate area thereof, a gearwheel (48) whose righthand side, again with reference to FIG. 4, is integral with a tubular member (49) coaxial with the said shaft (41).

The righthand end of the said tubular member (49) is inserted, and slidable a suitable distance, in the lefthand part of a sleeve (50) coaxial with the shaft (41) and provided at its extremities with rings coaxial there with, shown from left to right at (51) and (52).

The inner diameter of the ring (52) is in sliding contact with the shaft (41), while the righthand lateral face thereof rests against an annular element or collar (53) at the righthand end of the said shaft (41).

Internally of the sleeve (50) is housed a helical spring (54) wound around the said shaft (41), the ends of which rest against the righthand extreme of the tubular member (49) and against the lefthand face of the ring (52), respectively.

A roller (55) on a horizontal axis, supported rotatably by a spindle (56) integral with the body of a sector gear (57), runs in the groove of the plate cam (47).

The sector gear (57), placed in a vertical plane perpendicular to the shaft (41), has a fulcrum pin (58) parallel to the drive shaft (45) and supported rotatably by elements that are not illustrated, and the toothed end thereof meshes with the gearwheel (48).

A roller (59) on a vertical axis, supported rotatably by a spindle (60) fixed in an intermediate area of a horizontal lever (61), runs in the grooves of the cylindrical cam (46).

One end of the said lever (61) (the one at the rear in FIG. 4) has a fulcrum pin (62) that is vertical and is supported rotatably by non-illustrated elements. At the other end, the said lever (61) supports rotatably, by means of a spindle (63) that is also vertical, a vertical axis roller (64) placed in between the rings (51) and (52) integral with the sleeve (50).

The means for transmitting the motion to the shaft (42), only depicted in part in FIG. 4, terminate at two non-illustrated cams keyed onto the shaft (45) to the left of the cams (46) and (47), and they constitute, in accordance with what has been stated previously, a system symmetrical, with respect to the plane in which the wrapping wheel (12) lies, with that already described for the shaft (41).

For this reason, corresponding elements of the said symmetrical systems have been given the same numbers in FIG. 4.

A description will now be given of the way in which the improved machine according to the invention operates in order to achieve the formation of sticks of the second or of the first type described (illustrated in FIGS. 1, 2 and 4).

In both instances the grippers (15) are brought, one after the other, to a halt in the region of the said entry position (11), and their arms (16) are opened in order to receive a product (3).

Following the insertion of each product (3), along with its cutting of wrapping material, between the grasping ends of the grippers (15), in the way to which prior reference has been made, movable folder members, not illustrated since they are of a known type, carry out certain further folding operations on the said cutting.

While the said wrapping operations, which take place once the grippers (15) that have received a product (3) have reclosed, are being performed, the wrapping wheel (12) resumes its counterclockwise rotation movement.

During one rotation step that is one quarter of a revolution and carries the said product (3) to a point corresponding to the said overturning position (29), the stationary folder members (32) finalize the wrapping of the said product (3). While the said product (3) is in the said overturning position (29), the two cylindrical cams (46) cause a pivoting movement of the levers (61) about the pins (62) which, through the rollers (64) placed in between the rings (51) and (52), is converted into an axial displacement of the shafts (41) and (42) whereby the shafts moved toward each other.

The jaws (38) and (39) fixed thereto come in contact with the sides of the product (3) and grip it lightly in between them.

All risk of the product being damaged on account of excessive lateral compression is overcome because of the provision of the helical springs (54) which transmit the axial motions to the shafts (41) and (42).

The said helical springs (54) can be provided on both shafts (41) and (42) though their presence is also envisaged on one only since in the other the sleeve (50) is integral with the tubular member (49).

At this juncture, while the arms (16) of the grippers (15), operated by the ring shaped cam (26), start to open and release the said product (3), the plate cams (47) due to the aforementioned symmetrical systems, cause, via the rollers (55), the sector gears (57) to pivot about the pins (58).

Following this, the gearwheels (48) undergo a counterclockwise rotation thru 90° which, via the shafts (41) and (42) is imparted to the product (3) gripped between the jaws (38) and (39). The rotation of the product (3) takes place about one of its axes that passes through virtually the center of gravity of the product (3).

Then while the grippers (15), still operated by the ring shaped cam (26) reclose on the product (3) which is now arranged on the flat, i.e., has been turned so as to orient the largest pair of faces rotated 90° from the previous position, the cylindrical cams (46), by actuating the shafts (41) and (42) in the way previously described, move the jaws (38) and (39) away from the said product.

Two rotation steps of the wrapping wheel (12), spaced with a halting pause in between them, carry the products (3) in succession from the said overturning position (29) to the expulsion position (28).

Thus, while the grippers (15) reopen under the action of the ring shaped cam (26), the pusher or extractor (33), during a forward movement, engages with the back part of the product (3) enshrouded in its wrap, pushes the said product from the grippers (15) and transfers it into the fixed egress channel (36).

The products (3) are routed along the channel (36), in a way that is not illustrated, towards devices that cannot be seen in the figures but are designed to form batches of a predetermined number of products and to wrap the said batches in an external covering (5) in order to form sticks of the type illustrated in FIG. 2.

It is obvious from the foregoing that, thanks to the operation of the device (40), the products (3) arrive at the said expulsion position (28) placed on the flat with their largest surfaces coplanar, in line, a horizontal plane, and that they move one after another on the said fixed egress channel (36) with an arrangement such as to give rise to batches (4) of the second type (see again FIG. 2).

Should, instead, it be desired to transfer the products (3) one after another to the fixed egress channel (36) in a way that allows the formation of batches (1) of the first type (see FIG. 1), the ring shaped cam (26) that controls the opening and the closing of the grippers (15) has to be replaced with another, similar but with a different profile, with which the grippers (15) are not made to open in the region of the overturning position (29).

Furthermore, in such case it is also necessary to eliminate operation of the device (40) for grasping and rotating the products (3).

This can be done, for example, by interrupting the connection between the drive shaft (45) and the means that operate the device (40), taking care to keep the jaws (38) and (39) apart in such a way as to avoid their interference with the products (3) as the products pass across the overturning position (29).

In the condition that has just been outlined, that is to say, with the device (40) out of operation, the products (3), during their stay in the wrapping wheel (12), keep their largest faces substantially tangential to the profile of the wrapping wheel (12) itself, and move to the expulsion position (28) with the said faces oriented in facing relation.

The way in which they thus come to the fixed egress channel (36) thus follows an arrangement destined to create batches (1) of the first type.

What is claimed is:

1. An improved machine for wrapping, selectively orienting and packaging articles of parallel piped configuration, comprising:

a wrapping wheel, means to intermittently rotate said wheel about an axis from an article entry position through an article overturning position and to an article discharging position seriatim, said wheel carrying a plurality of radially extending article grippers, each of said plurality of grippers being adapted to grasp at the free ends thereof an article together with a sheet of wrapping material;

means for infeeding each said article with it's sheet of wrapping material simultaneously to one of said grippers at said article entry position;

means, disposed along the path taken by said grippers between said entry and overturning positions, for folding said sheet of wrapping material to wrap said article therein;

overturning means for grasping an article brought to said overturning position by said gripper and for rotating by 90° said article at said article overturning position after said grippers are opened and while said grippers are temporarily stopped thereat, and then for causing said grippers to regrip said now turned by 90° article and for releasing said grasping means;

gripper operating means including either one of a first and a second ring-shaped cams, said first cam comprising means for opening and closing said grippers at said article entry and discharging positions and said second cam comprising part of said overturning means and means for opening and closing said grippers at said article entry, discharging and overturning positions while said grippers are temporarily stopped thereat, said gripper operating means operating in synchronization with the intermittent rotation of said wrapping wheel;

said overturning grasping and rotating means being operative only when said gripper operating means is equipped with said second ring-shaped cam which allows said grippers to operate at said article overturning position as well as at said article entry and discharging positions, means for pushing said articles which have been transferred to said article discharging position thereby removing said wrapped articles from said grippers while they are stopped temporarily at said article discharging position; and means, disposed in alignment with the path taken by said pushing means, for guiding a succession of said removed, wrapped articles so that a predetermined number of said articles are secondarily wrapped as a whole into a final package, whereby the selection of said first or second ring-shaped cam permits said machine to produce selectively two different types of packages of said wrapped articles, one type of package being characterized by the arrangement of said articles with their major faces facing each other, and the other type characterized by the arrangement with their major faces in line.

2. An improved machine according to claim 1, wherein said overturning grasping and rotating means comprises a pair of opposing jaws disposed symmetrically one to each other with respect to the plane of said wrapping wheel containing said grippers, means to have said jaws synchronously towards and away from each other along respective sliding axes parallel to said axis of said wrapping wheel to grasp and release an article at said article overturning position and to provide synchronous rotary movements of said jaws about said respective sliding axes to turn said article through 90° at said overturning position in time with said lateral sliding movements thereof.

3. An improved machine according to claim 2, wherein said means to move said jaws (38,39) motion comprises:

a pair of shafts (41,42) whose axes are said respective sliding axes, and which each include a portion at one end thereof supporting said jaw and a collar member (53) at the other end thereof;

a cylindrical cam (46) having an axial disposed groove;

a horizontally pivoting lever (61) having at a middle portion thereof a first cam follower pin (60) and at a free end thereof a roller pin (63), both of said pins extending vertically of said horizontally pivoting lever;

a first cam follower (59) supported by said first cam follower pin and engaging said axially disposed groove in said cylindrical cam;

a sleeve (50) axially slidably disposed on said shaft and having a pair of rings (51, 52) at one end portion thereof, one of said pair of rings (52) being slidable on said shaft and an outer face thereof mating an inner face of said collar member of said shaft;

a roller (64) supported by said roller pin and received between said pair of rings;

a tubular member (49) axially slidably disposed on, and keyed to a middle portion of, said shaft, slidably inserted in one end portion of said sleeve remote from said one of the pair of rings (52), and having at a middle portion thereof a gearwheel (48);

a spring (54) interposed between the inner surface of said sleeve and the surface of said shaft, one end thereof biasing said one of the pair of rings against said inner face of said collar member and the other end thereof biasing one end of said tubular member, located inside said sleeve, toward said jaws;

a plate cam (47) simultaneously driven with said cylindrical cam and having a radially displacement groove;

a vertically pivoting lever (57) pivoting in a plane perpendicular to said respective sliding axes of said jaws and to the plane of pivoting of said horizontally pivoting lever, said vertically pivoting lever having at a middle portion thereof a second cam follower pin (56) extending axially of said shaft, and further having at one end thereof a sector gear portion (57) which meshes said gearwheel of said tubular member;

a second cam follower (55) supported by said second cam follower pin and engaging said radial displacement groove in said plate cam, whereby the rotary movement of said cylindrical cam is synchronous with the rotary motion of said wrapping wheel, and causes said horizontally pivoting lever to pivot horizontally about a fulcrum thereof located at an end thereof opposite to said free end, thereby allowing said shaft to move axially toward and away from said article overturning position to open and close said jaws, and the rotary movement of said plate cam causes said vertically pivoting lever to pivot vertically about a fulcrum thereof located at the other end thereof opposite to said sector gear portion, thereby allowing said gearwheel, said shaft and said jaws to turn.

4. An improved machine according to claim 2 or 3, wherein said pair of opposing jaws are adjustable as to the distance therebetween along said respective sliding axes.

* * * * *